United States Patent [19]

Albers

[11] 4,391,108

[45] Jul. 5, 1983

[54] DRUM FOR A CONTINUOUSLY OPERATING LAUNDRY PROCESSING MACHINE

[75] Inventor: Richard R. Albers, Warren, N.J.

[73] Assignee: Passat-Maschinenbau GmbH, Heilbronn, Fed. Rep. of Germany

[21] Appl. No.: 204,659

[22] Filed: Nov. 6, 1980

[30] Foreign Application Priority Data

Nov. 7, 1979 [DE] Fed. Rep. of Germany ..... 2944857

[51] Int. Cl.[3] ..... D06F 21/02; D06F 37/08

[52] U.S. Cl. ..... 68/143; 68/145; 198/658

[58] Field of Search ..... 68/58, 142–146, 68/27; 198/658

[56] References Cited

U.S. PATENT DOCUMENTS 1,154,675 9/1915 Vaudreuil ..... 198/658 X 1,254,187 1/1918 Aldrich ..... 68/142

2,337,137 12/1943 Thompson et al. ..... 68/144 X

FOREIGN PATENT DOCUMENTS 1964414 7/1971 Fed. Rep. of Germany ..... 68/58

586299 12/1958 Italy ..... 68/142

593983 2/1978 U.S.S.R. ..... 198/658

*Primary Examiner*—Philip R. Coe

*Attorney, Agent, or Firm*—Mason, Mason & Albright

[57] ABSTRACT

A drum for a continuously operating laundry processing machine is constructed from a number of individual elements. Each element consists of an upper and a lower portion having a surface of helical shape which defines part of the drum shell, and a surface of right helicoidal shape which defines part of a right helicoidal conveying screw which divides the drum into individual chambers. The parts forming the drum are connected by externally welded seams.

8 Claims, 9 Drawing Figures

DRUM FOR A CONTINUOUSLY OPERATING LAUNDRY PROCESSING MACHINE

BACKGROUND OF THE INVENTION

1. Field of the Invention

The invention relates to a drum for a continuously operating laundry processing machine, in particular a single drum washing machine.

2. Description of the Prior Art

There is proposed in German patent application No. P 1 964 414 a drum comprising a drum shell and a conveying screw which divides the drum into individual chambers. The manufacture of such a drum has proved to be particularly troublesome, because after rolling the abutting portions of the drum shell and welding them together to give the continuous drum shell, all remaining welding and grinding work can only be carried out from inside the drum shell. As chambers are formed in the drum shell by the conveying screw, the nuisance to the worker due to gases given off during welding, noise and the influence of dust is considerable. In addition, the welder has no visual contact with the outside, and the drum can only be traversed by turning it. The danger of accidents resulting from this is a further drawback of this method of manufacture. In addition, because of the limited space availability, naturally only a small number of workers can work together on the construction of such drums, this being a drawback which affects the construction times and thus the manufacturing costs detrimentally. Because of the largely manual construction of such drums, for which the drum length and thus the number of washing chambers have to match the respective requirements of the order, industrial manufacture of large numbers on a rational basis is in any case impossible.

SUMMARY OF THE INVENTION

According to the invention there is provided a drum for a continuously operating laundry processing machine, comprising a drum shell, a conveying screw composed of right helicoids which divide the drum into individual chambers, and a central pipe disposed on the central axis and which is divided by the helicoids of the conveyor screw into individual central pipe portions associated with the chambers, the drum being constructed from individual elements joined to each other by weld seams, each element comprising an upper portion and a lower portion which can be welded together in the horizontal middle plane of the drum, each of said upper and lower portions consisting of a surface which follows the shape of a helix and forms a part of the drum shell, and a surface corresponding to a half helicoid of the conveying screw and provided with means defining a central recess for the central pipe, said half helicoid surface being welded to the said surface forming a part of the drum shell of the said portion.

In a preferred embodiment, the width of the surface which follows the shape of the helix and forms a part of the drum shell is equal to the pitch of one right helicoid of the conveying screw.

The surface following the shape of a helix is desirably constructed from plates which can be welded together, these being either flat-surfaced or curved to correspond to the drum diameter.

Advantageously, each plate is rhombus-shaped in outline, which is provided on its sides with bent-over edges which lie against corresponding bent-over edges of the neighbouring plates or on the associated half helicoid of the conveying screw and are welded thereto from the outside.

In a drum in which entrainment ribs are provided in the longitudinal direction of the drum shell and are distributed over its inner surface, corrugated depressions are provided in the region of two abutting positions in each plate, their depressed portions forming part of an entrainment rib.

BRIEF DESCRIPTION OF THE DRAWINGS

An embodiment of the drum according to the invention is described, by way of example only, with reference to the accompanying diagrammatic drawings, in which.

DESCRIPTION OF THE PREFERRED EMBODIMENT

Figure 8:
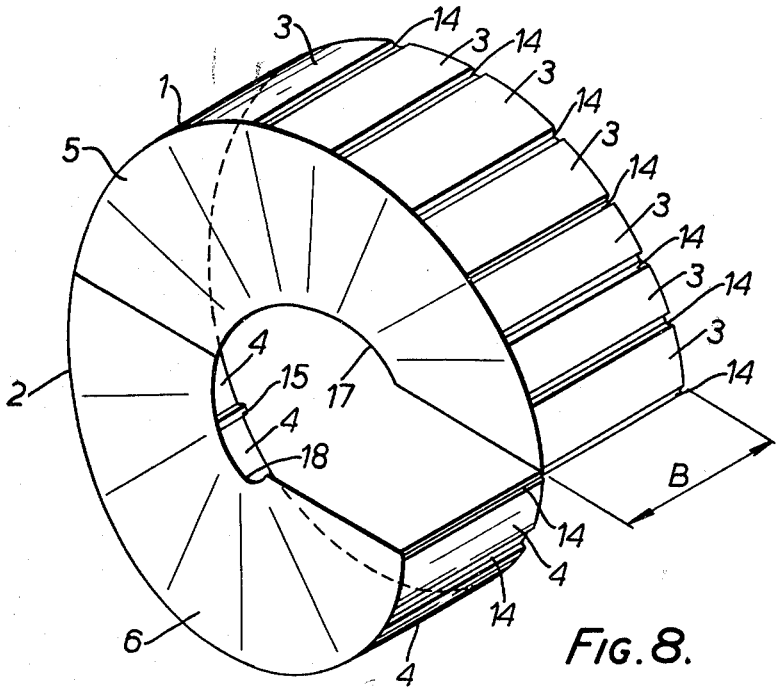
FIG. 8 is a perspective view of an element of the drum consisting of the upper portion and lower portion of FIGS. 1 and 2.

The reference numeral 1 represents an upper portion and 2 the lower portion which, as shown in detail in FIG. 8 of the drawing, form one element of the drum of a single drum washing machine. The two portions 1 and 2 can be welded together in the horizontal middle plane of the drum.

Figure 9:
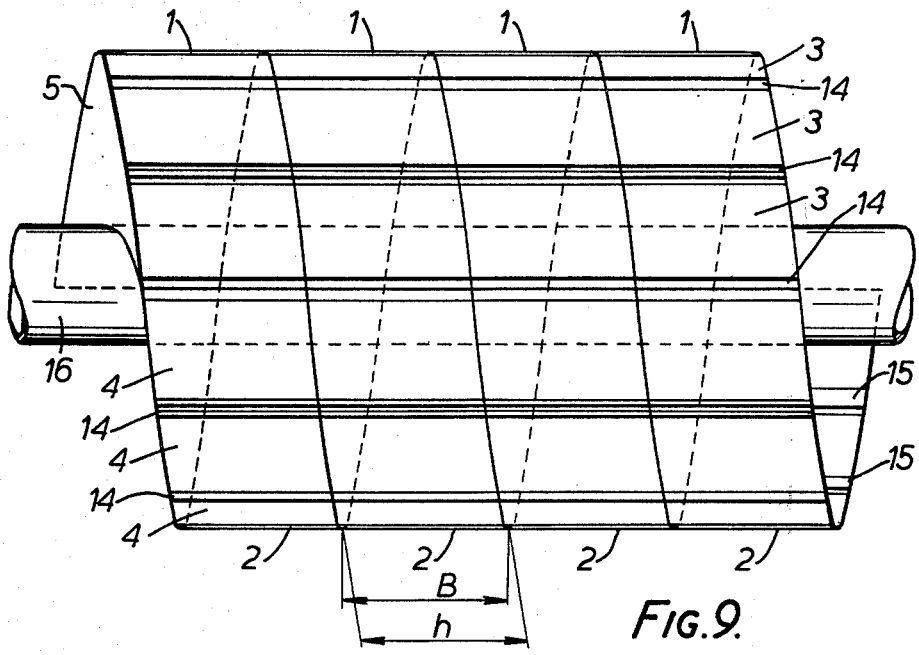
FIG. 9 is a fragmentary view of the drum according to the invention.

The upper portion 1 and lower portion 2 each consist of a surface 3, 4 respectively, which follows the shape of a helix and forms a part of the drum shell, and a surface 5, 6 respectively, each of which forms a half right helicoid of a conveying screw, and which can be welded to the surfaces 5, 6 respectively, to take a central pipe 16 (FIG. 9).

The width B of the surface 3 of the upper portion 1 and of the surface 4 of the lower portion 2 which follow the shape of a helix and form a part of the drum shell is equal to the pitch of a right helicoid 5 and 6 of the conveying screw.

Figure 1:
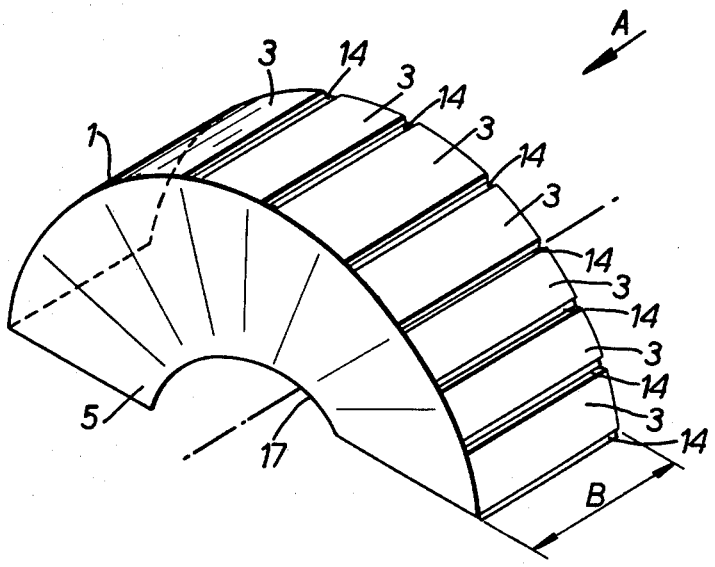
FIG. 1 is a perspective view of an upper portion of an element of a drum according to the invention.
Figure 2:
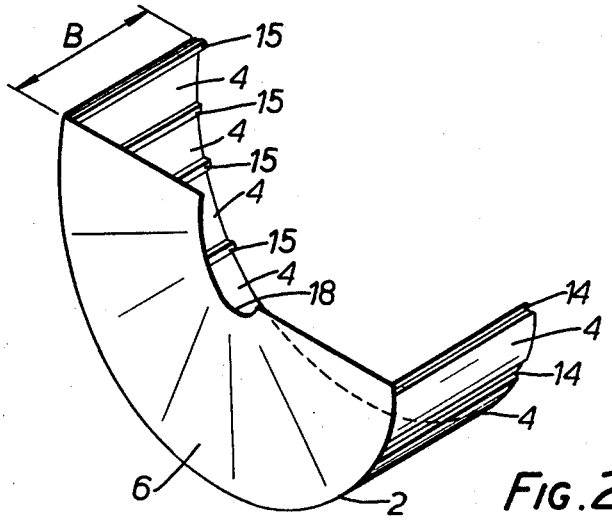
FIG. 2 is a perspective view of a lower portion of an element of the drum.
Figure 3:
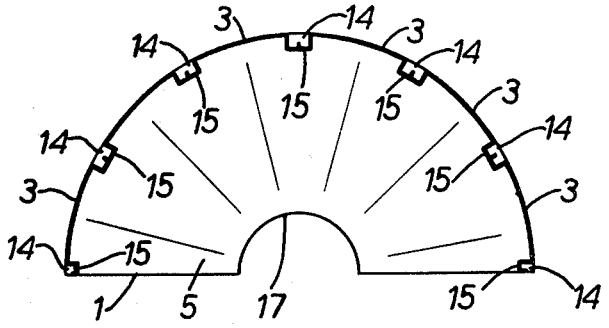
FIG. 3 is a view in the direction of the arrow A of FIG. 1.
Figure 4:
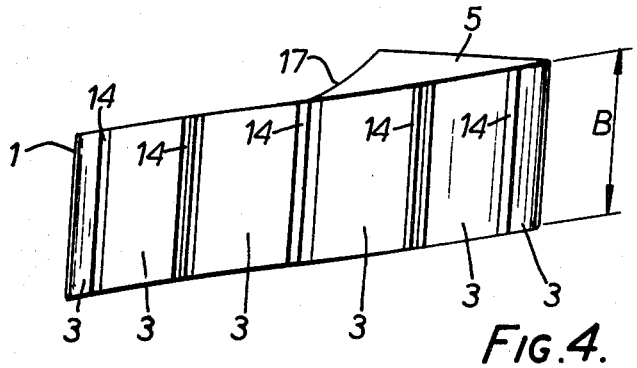
FIG. 4 is a plan view corresponding to FIG. 1.
Figure 5:
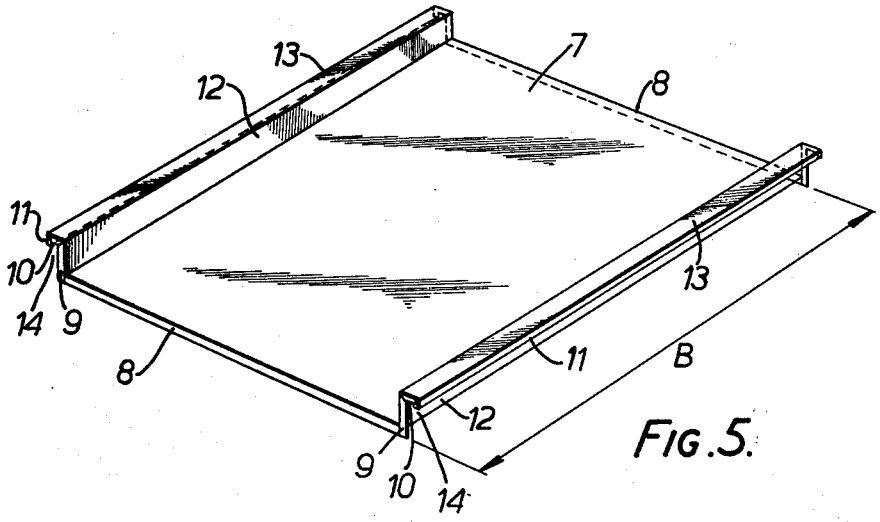
FIG. 5 is a perspective view of a plate from which the drum shell is assembled by welding.
Figure 6:
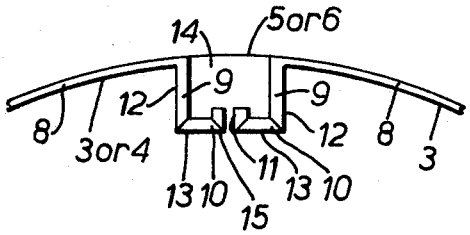
FIG. 6 is a fragmentary section through the drum shell transversely to an entrainment rib.
Figure 7:
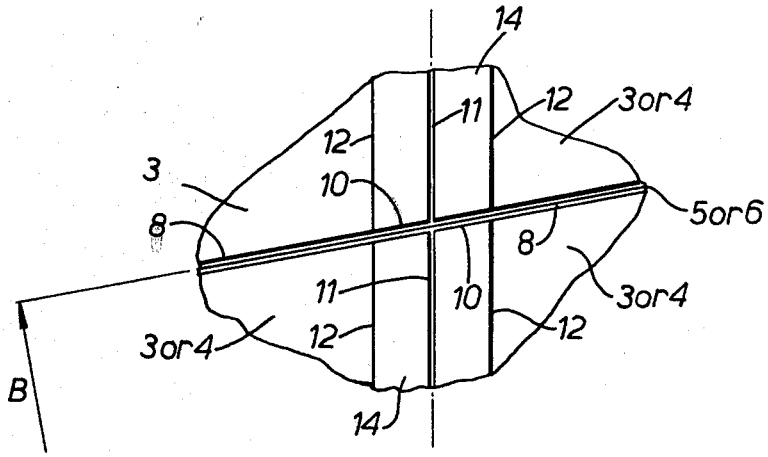
FIG. 7 is a fragmentary view of the outside of the drum shell showing the weld joint positions and is a plan view equivalent to FIG. 6.

The surface 3, 4 which follows the shape of a helix and forms a part of the drum shell is constructed from flat or curved plates 7 welded to each other, one plate of which is shown in detail in FIG. 5 of the drawing.

Each plate 7 is in the form of a rhombus in outline. This form is necessary because of the requirement that the surface 3, 4 follows the shape of a helix. Bent-over edges 8, 13 are provided at the sides of the plate 7, and lie against corresponding bent-over edges of the neighbouring plates 7 and against the respective associated helicoid 5, 6, and are welded thereto from the outside.

FIG. 5 of the drawing also shows corrugated depressions 14 in the region of the abutting portions of adjacent plates 7, an inwardly projecting side 13 of this depression forming part of an entrainment rib 15. The entrainment ribs 15 extend in known manner in the longitudinal direction of the drum shell, and are distributed over the inner surface thereof.

The drum is assembled as follows:

The upper portion 1 and lower portion 2 of determined outer diameter are firstly constructed from parts in stock. This is done by externally welding the surfaces 3, 4 to the helicoids 5, 6 respectively.

After the order has been placed, and according to the required length of the drum, a trough-shaped structure is then constructed from individual lower portions 2 by welding them together, so that the helicoids 6 form individual walls. The central pipe 16 is then inserted into the recesses 18 in the spaced-apart and mutually facing helicoids 6, and is welded thereto.

Finally, the upper portions 1 are mounted successively on the associated lower portions 2, and are welded to these and to the central pipe 16. The right helicoids of the conveying screw formed by the half helicoids 5 and 6 divide the drum into individual chambers and the central pipe is divided by the helicoids into individual pipe portions each of which portion is provided with outlet openings leading to the individual chambers.

By virtue of the described construction, welding work in the closed drum is dispensed with, whereby the accident danger and noise nuisance are reduced to a minimum. Neither is any traversing of the drum required. On the contrary, all welding work can be carried out from the outside. Moreover, in this manner it is possible to manufacture a wash drum corresponding to the respective requirements (articles to be laundered, washing time etc.), from standard stock-held elements in a short time, which has a favourable effect on the construction times and corresponding manufacturing costs. Because of this, stock-keeping is simplified and rationalised.

As soon as the drum length and required number of chambers are determined in accordance with the conditions of the order, a trough-shaped structure with intermediate walls is welded together from the lower portions, for which only external weld seams are required. The central pipe is then welded to the half right helicoids of each lower portion, and also in this case the corresponding weld seams can be comfortably made. Finally, the corresponding upper portions are mounted successively on the individual lower portions, and the upper portions can likewise be joined to the associated parts, i.e. the central pipe and lower portions, by external weld seams.

As interior work inside the drum is dispensed with by these means, a simple, dangerless and low-noise operation is ensured. As the lower portions and upper portions can be held in stock, transition from manual to industrial construction is possible on a wide basis. Any nuisance due to welding gases and grinding dust also disappears.

What is claimed is:

1. A drum for a continuously operating textile processing machine, comprising a drum shell, defining an interior space having a central longitudinal axis and a horizontal middle plane, a conveying screw composed of right helicoids which divide the interior space of the drum shell into individual chambers, the drum being constructed from individual elements joined to each other by weld seams, each element comprising an upper portion and a lower portion which are welded together in the horizontal middle plane of the drum interior space, each of said upper and lower portions consisting of a surface which follows the shape of a helix and forms a part of the drum shell, and a surface corresponding to a half helicoid of the conveying screw, said half helicoid surface being welded to the said surface forming a part of the drum shell of the said portion.

2. A drum as claimed in claim 1, wherein in each portion, the said surface which follows the shape of a helix has a width equal to the pitch of a said helicoid of the conveying screw.

3. A drum as claimed in claim 1, wherein in each portion, the said surface which follows the shape of a helix is constructed from plates which are welded together.

4. A drum as claimed in claim 3, wherein the plates are flat.

5. A drum as claimed in claim 3, wherein the plates are curved.

6. A drum as claimed in claim 3, wherein each plate is rhombus-shaped in outline and has sides with bent-over edges, the respective edges lying against corresponding bent-over edges of the adjacent plates and against the associated right helicoid of the conveying screw, and are welded thereto from the outside.

7. A drum as claimed in claim 6, comprising means defining corrugated depressions in the regions at which each plate abuts the plates adjacent thereto, each depression comprising an inwardly directed side which forms part of an entrainment rib, said ribs extending in the longitudinal direction of the drum shell and being distributed over its inner surface.

8. A drum as claimed in claim 1, further comprising a central pipe disposed on said central axis and which is divided by the helicoids of said conveyor screw into individual central pipe portions associated with said chambers, each surface of said portions corresponding to the half helicoid of said conveying screws being provided with means defining a central recess for said central pipe.

* * * * *